US005203194A

United States Patent [19]

Marquardt

[11] Patent Number: 5,203,194

[45] Date of Patent: Apr. 20, 1993

[54] METHOD OF FORMING A TRAILER HITCH RECEIVER TUBE

[75] Inventor: Herman Marquardt, Pinckney, Mich.

[73] Assignee: Great Lakes Tool and Machine, Milford, Mich.

[21] Appl. No.: 802,497

[22] Filed: Dec. 5, 1991

[51] Int. Cl.[5] ..... B21D 41/02; B21D 53/88

[52] U.S. Cl. ..... 72/316; 72/318; 72/370; 72/358; 280/491.2; 29/897.2

[58] Field of Search ..... 72/318, 370, 377, 358, 72/359, 357, 316; 29/897.2; 280/491.2, 491.1, 491.5; 138/177, DIG. 11

[56] References Cited

U.S. PATENT DOCUMENTS

| | | | |
|---|---|---|---|
| 1,882,352 | 10/1932 | Woodhead | 29/897.2 |
| 2,053,975 | 9/1936 | Spatta | 72/358 |
| 4,213,322 | 7/1980 | Barnes | 72/370 |
| 4,845,972 | 7/1989 | Takeuchi | 72/370 |

FOREIGN PATENT DOCUMENTS

| | | | |
|---|---|---|---|
| 3216287 | 11/1983 | Fed. Rep. of Germany | 72/318 |
| 6384 | 2/1973 | Japan | 72/318 |
| 163542 | 9/1983 | Japan | 72/316 |
| 118348 | 6/1985 | Japan | 72/318 |
| 264995 | 2/1927 | United Kingdom | 138/177 |

*Primary Examiner*—Daniel C. Crane

*Attorney, Agent, or Firm*—Harness, Dickey & Pierce

[57] ABSTRACT

A method of forming a receiver tube for a motor vehicle trailer hitch assembly. The method involves a forming operation in which a length of square tube stock is mechanically formed to define a reinforcing bead around the hitch receiving end of the tube. The process further partially forms and sizes the inside surface of the tube. The resulting receiver tube improves over prior art multi-piece constructions in terms of appearance and corrosion resistance.

3 Claims, 2 Drawing Sheets

METHOD OF FORMING A TRAILER HITCH RECEIVER TUBE

BACKGROUND AND SUMMARY OF THE INVENTION

This invention relates to a component for a motor vehicle trailer hitch assembly and in particular, to a novel receiver tube construction.

Trailer hitches of the type used for conventional motor vehicles frequently have a receiver tube permanently mounted to the vehicle which receives a removable trailer hitch bar. A conventional mounting ball for a trailer tongue is mounted on the hitch bar. These types of trailer hitches are in wide-spread use today, and are often used for hauling boats, travel trailers, utility trailers, etc. Hitch receiver tubes are usually mounted to the vehicle frame or body using one or more cross braces. The receiver tube opens toward the rear of the vehicle for receiving the hitch bar, which is a square cross-section solid bar of metal which is slid into the receiver tube.

In order to reinforce the rear-facing opening of the receiver tube, during fabrication of the hitch, a reinforcing ring is slid onto the receiver tube end and welded in place. Although this conventional construction for receiver tube fabrication provides an acceptable product, it has several disadvantages. The receiver tube end is visible when viewing the rear of the vehicle, and being of welded construction, has appearance disadvantages. More importantly, however, the weld beads joining the receiver tube and the reinforcing ring are a prime area for the generation of corrosion. In addition, since it is unpractical to fit the reinforcing ring to the receiver tube without separation gaps between them, areas for the collection of contaminants are present, further leading to corrosion problems. Also significant is the fact that the multipiece construction of the conventional receiver tube requires two components to be separately manufactured, transported, handled and welded in place in order to complete the receiver tube.

This invention seeks to provide an improved trailer hitch receiver tube of integral construction in which the receiving end is reinforced through a metal forming process. The process of the invention of forming the receiving end also simultaneously accurately sizes and forms the inside cavity of the receiver tube. The resulting trailer hitch receiver tube has a much improved appearance having no weld beads or rough metal edges visible. The integral construction also eliminates pockets for contaminant collection and provides exceptional reinforcement of the tube seam weld. The receiver tubes produced according to this invention further reduces manpower and assembly requirements, thus providing efficient production capabilities.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE INVENTION

Figure 1:
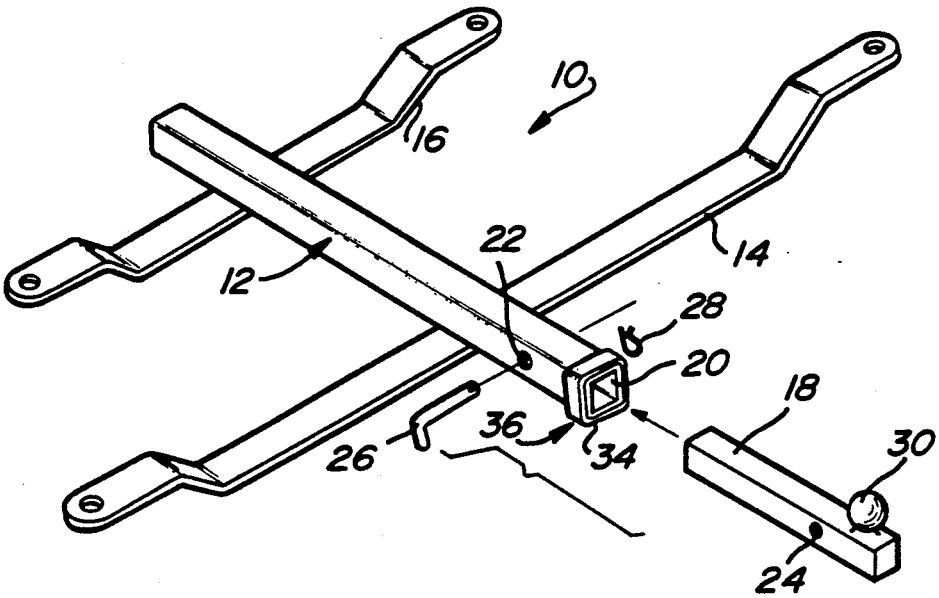
Fig-1 PRIOR ART
FIG. 1 is a pictorial view of a trailer hitch assembly in accordance with the prior art.

A trailer hitch assembly according to the prior art is shown in FIG. 1 and is generally designated there by reference number 10. Trailer hitch assembly 10 generally comprises receiver tube 12, mounting cross members 14 and 16, and hitch 18. Trailer hitch assembly 10 would be mounted beneath the vehicles floor pan at the rear of the motor vehicle (not shown) by welding or fastening cross members 14 and 16 to vehicle frame members. Receiver tube 12 has a hollow interior passage 20 which closely receives hitch bar 18. When the vehicle operator wishes to use the vehicle for towing, hitch bar 18 is slid into receiver tube passage 20 until the holes within receiver tube 12 and hitch bar 18, identified by reference numbers 22 and 24 respectively, are aligned. Upon reaching this position, locking pin 26 is slid into place and retainer clip 28 is passed through a small hole in the locking pin 26. As shown, hitch bar 18 has a mounting ball 30 which supports a conventional trailer tongue (not shown).

Figure 2:
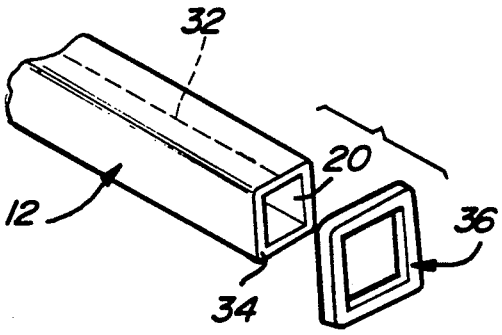
Fig-2 PRIOR ART
FIG. 2 is a pictorial exploded view of the trailer hitch receiver tube according to the prior art construction.
Figure 3:
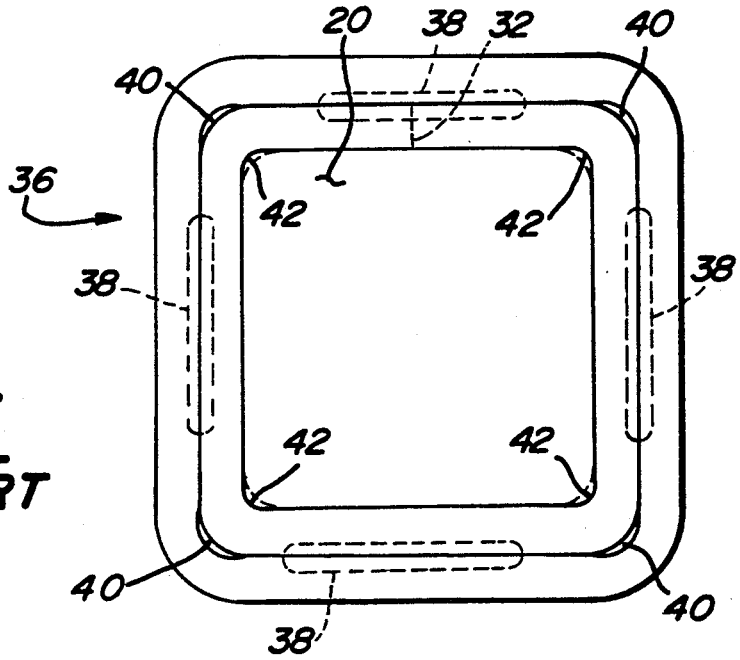
Fig-3 PRIOR ART
FIG. 3 is a rear view of the receiving end of the receiver tube of the prior art showing the reinforcing ring in place.

The manner of construction of a conventional receiver tube 12 is further illustrated with reference to FIG. 2. The dotted line along the outer surface of receiver tube 12 in FIG. 2 designates the seam weld 32 which is present in conventional receiver tubes. The seam weld 32 is present since trailer hitch receiver tubes are conventionally formed from sheet metal stock and welded to form a closed section. The presence of seam weld 32 gives rise to a concern over mechanical failure of the receiver tube along the weld seam. This concern as well as the significant loads acting on receiving tube receiving end 34 leads to the requirement that the receiving end be reinforced. In accordance with prior art constructions, such reinforcement is provided through the use of a separate reinforcing ring 36 which is slid onto the end of receiver tube 12 and welded in place. FIG. 3 illustrates the reinforcing ring 36. Weld beads 38 are placed on the forward facing junction of the components (shown in phantom lines in FIG. 3) which join the components together.

As mentioned previously, it is not practical to assembly tube 12 and ring 36 in a manner in which they are in continuous intimate contact entirely around their perimeter. As is shown in FIG. 3, clearance spaces 40 typically are present at the corners or the receiver tube 12 and reinforcing ring 36. Clearance spaces 40 are undesirable since they detract from the finished appearance of the receiver tube 12, and form an area for collecting contaminants.

FIG. 3 also illustrates that the inside corners of 42 of receiver tube 12 define a given radius of curvature. It is necessary to provide a smaller radius corner (i.e. a "sharper" corner) than is originally present in receiver tube 12 as supplied. It is, therefore, necessary to extrude or form these inside corners from the shape of tube stock as received, designated in phantom lines, to the full line shape shown in FIG. 3. Conventionally this is done by using a cold forming tool having sharp corner edges which is pushed through the tube which cold-forms the material within the corners to define the desired radius of curvature.

Figure 4:
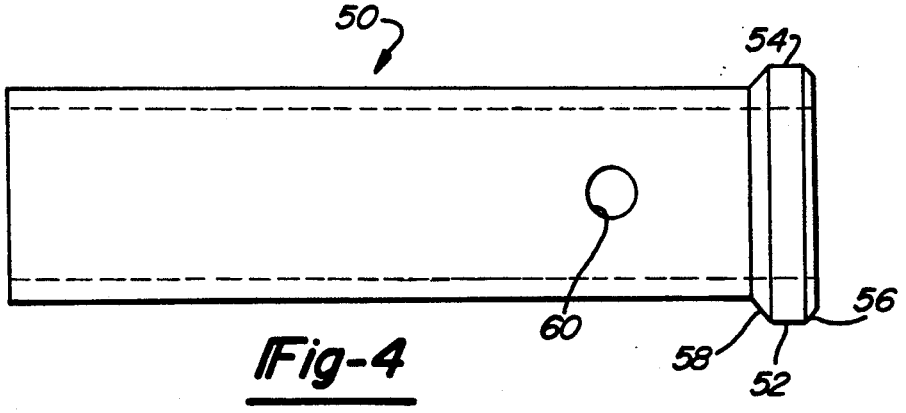
FIG. 4 is a side view of a receiver tube produced in accordance with the method of this invention featuring unitary construction.

Now with reference to FIG. 4, a receiver tube in accordance with the process of this invention is shown which is generally designated by reference number 50. Receiver tube 50 is formed from tube stock as in the prior art construction except that it integrally forms a reinforcing bead 52 as will be described in greater detail below. Bead 52 is formed through a metal forming operation beginning with tube stock identical to that of the prior art. The bead 52 defines an outer perimeter surface 54, with chamfered edges 56 and 58. As in the prior embodiment, receiver tube 50 defines a hole 60 for receiving a locking pin 26 once a hitch bar 18 is installed. Also like the prior embodiment, receiver tube 50 is welded or otherwise connected to a motor vehicle using mounting cross braces or other connecting members.

The integral construction of receiver tube 50 eliminates areas for containment collection present in prior art constructions. Furthermore, the end of receiver tube 50 has no weld beads as corrosion sites. The visual appearance of receiver tube 50 is vastly improved over the prior construction. Assembly manpower requirements are also significantly reduced.

Figure 5:
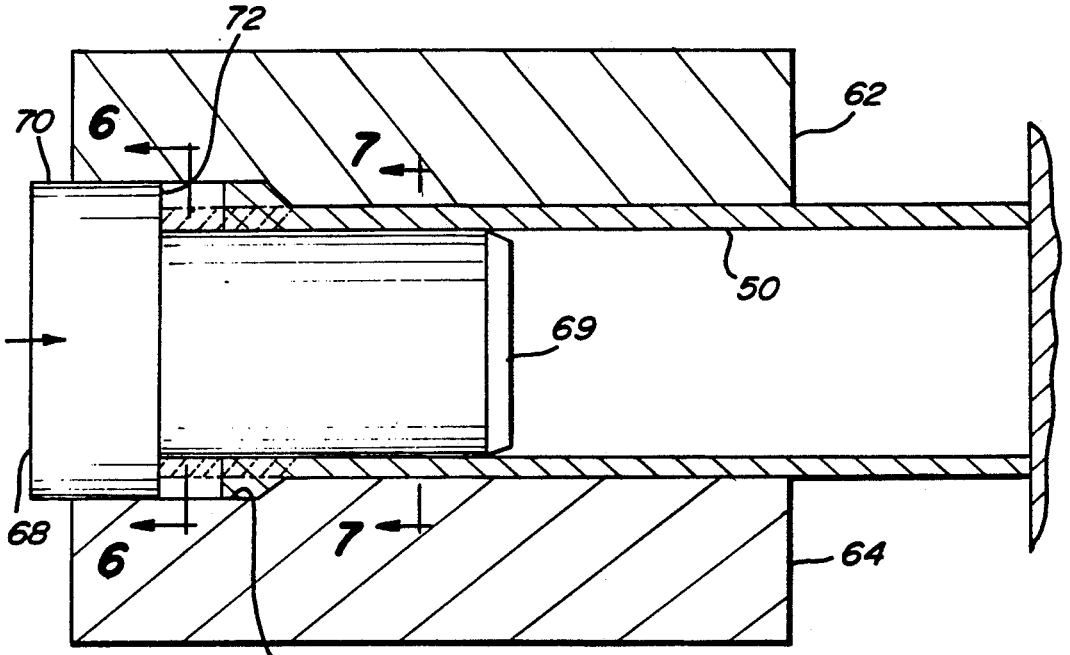
FIG. 5 illustrates a metal working tool for forming the reinforced receiving end of the receiver tube in accordance with this invention.
Figure 6:
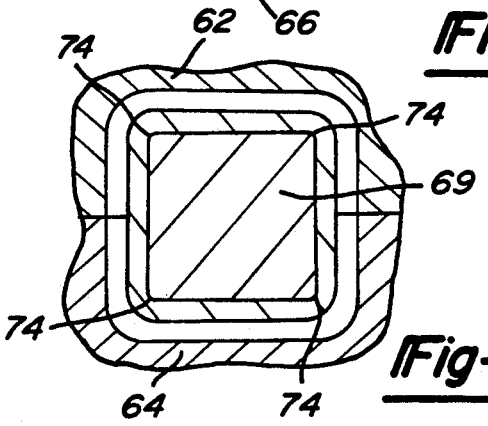
FIG. 6 is a cross-sectional view taken along lines 6—6 of FIG. 5.
Figure 7:
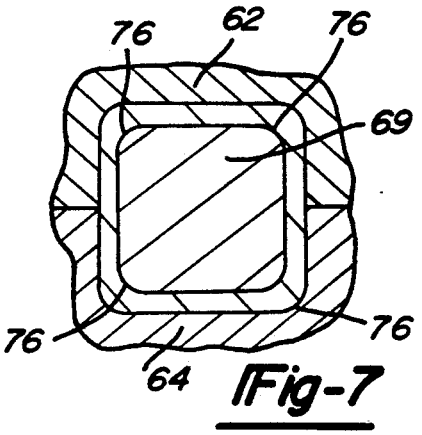
FIG. 7 is a cross-sectional view taken along lines 7—7 of FIG. 5.

A machine for forming receiver tube 50 is shown in FIG. 5. As shown, a die is provided having two symmetric die halves 62 and 64. Die halves 62 and 64 are forced together and closely receive and clamp against the outer surface of receiver tube 50. Die halves 62 and 64 define a bead forming region 66 defining the outside outline of receiver tube bead 52. Punch 68 is formed to be inserted within the receiving end of receiver tube 50 and defines an enlarged head 70 with a radial forming surface 72. During the process of forming receiver tube 50, punch post 69 is forced inside of receiver tube 50. As shown in FIG. 5, radial forming surface 72 initially engages the undeformed end of receiver tube 50 and upsets the end to define head region 52 as shown in the Figure. With reference to FIG. 5, punch 68 is initially shown in a position just engaging the end of receiver tube 50. FIG. 5 also shows the fully formed bead region as punch 68 is displaced to the right, forcing the material at the end of the tube to fill die bead forming region 66. During the process stop 78 helps to prevent the tube from moving relative to die halves 62 and 64. The process is preferably carried out with the tube stock at an elevated temperature, for example around 1800° F. and the forming operation carried out rapidly. The preferred process can be categorized as a "hot upset" operation.

In addition to forming bead region 52, punch 68 also at partially extrudes the inside corners of the tube 50 in the region of bead 52. The area of punch 68 which fits inside of receiver tube 50 adjacent radial forming surface 72 has small radius corners 74 for example about a 0.090 inch radius which deforms the inside of the tube to a sharp corner, like that of the prior art tube shown as corner 42 in FIG. 3. Further from forming surface 72, punch 68 has more rounded corners 76. The partial forming of the inside corners of receiver tube 50 is desirable since in a subsequent processing operation in which the remainder of receiver tube 50 is extruded, it is not necessary to disturb the material defining bead region 52 after it is formed. In a modified process, post 69 could be lengthened and made to fully extrude the inside corners of the tube along its entire length.

While the above description constitutes the preferred embodiments of the present invention, it will be appreciated that the invention is susceptible of modification, variation and change without departing from the proper scope and fair meaning of the accompanying claims.

I claim:

1. A method of forming an elongated receiver tube for a motor vehicle trailer hitch assembly of the type wherein said receiver tube has a hollow interior passage which receives a hitch bar having a rectangular cross section, comprising the steps of:

providing an elongated rectangular cross-section hollow tube having a substantially uniform wall thickness, providing die means having a forming surface for defining an enlarged bead end for said receiver tube, said forming surface including a stop separating the enlarged bead end from a tube receiving portion of the die means, providing a single punch having a post fitting with a rectangular cross section for engagement within said rectangular tube hollow interior passage and said punch having a radial forming surface engageable with an end of said tube, said rectangular post defined by small radius corners adjacent said radial forming surface and more rounded corners at a leading end of the post, loading said tube into said die means with said end positioned within said bead forming surface and extending a desired distance from said stop, placing said punch with said post in said tube interior passage with said radial forming surface engaging said end of said tube, forcibly displacing said punch against said tube end causing said end to be deformed to conform to said die and post forming surfaces thereby providing a bead around said tube end having an increased wall thickness thereby strengthening said tube end and forming sharper corners in the interior of the bead and more round corners in the tube interior contacting the post; and forming an elongated receiver tube for a motor vehicle trailer hitch assembly.

2. A method of forming according to claim 1 wherein said die is formed by a pair of die halves which part from one another along a plane aligned with the longitudinal axis of said tube.

3. A method of forming according to claim 1 wherein said method is conducted with said tube at an elevated temperature.

* * * * *